US007163430B1

(12) United States Patent
Lund et al.

(10) Patent No.: US 7,163,430 B1
(45) Date of Patent: Jan. 16, 2007

(54) WALKING TOY FIGURE

(76) Inventors: Bruce D. Lund, 551 Jackson, River Forest, IL (US) 60305; Michael D. Slarrick, 811 N. Third Ave., Maywood, IL (US) 60153; Sunil Moothedath, 4104 N. California, #2, Chicago, IL (US) 60618

( * ) Notice: Subject to any disclaimer, the term of this patent is extended or adjusted under 35 U.S.C. 154(b) by 0 days.

(21) Appl. No.: 11/009,838

(22) Filed: Dec. 13, 2004

(51) Int. Cl.
*A63H 7/00* (2006.01)

(52) U.S. Cl. ..... 446/355; 446/352; 446/377

(58) Field of Classification Search ..... 446/352–356, 446/377, 390, 358, 330
See application file for complete search history.

(56) References Cited

U.S. PATENT DOCUMENTS 1,800,874 A * 4/1931 Savage ..... 446/355
2,965,385 A * 12/1960 Ayala ..... 280/1.181
3,484,988 A * 12/1969 Robbins ..... 446/355
4,302,903 A * 12/1981 Pun ..... 446/351
4,349,987 A * 9/1982 Bart ..... 446/355
4,944,708 A * 7/1990 Kawabe ..... 446/175
5,224,896 A * 7/1993 Terzian ..... 446/355
5,326,302 A * 7/1994 Llorens ..... 446/288
5,376,038 A * 12/1994 Arad et al. ..... 446/297
6,322,420 B1 * 11/2001 Daniellian ..... 446/300
6,500,043 B1 * 12/2002 Fong ..... 446/330
6,645,036 B1 * 11/2003 Lund et al. ..... 446/355
6,746,301 B1 * 6/2004 Lund et al. ..... 446/298

* cited by examiner

*Primary Examiner*—Bena Miller
(74) *Attorney, Agent, or Firm*—Much Shelist Freed Denenberg

(57) ABSTRACT

A movable toy animal having legs that are controlled by a motor operated teeter-totter assembly. The motor is bi-directional and sequentially moves the legs in opposite directions to move the animal in a forward walking, running or turning direction. Various switches and mechanisms are provided to obtain the desired movement by a battery operated program controller.

3 Claims, 3 Drawing Sheets

Fig 4a
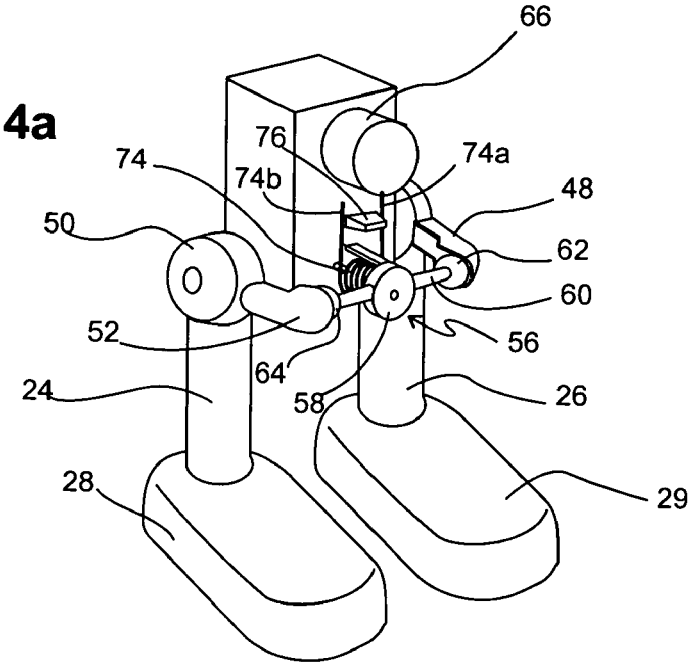
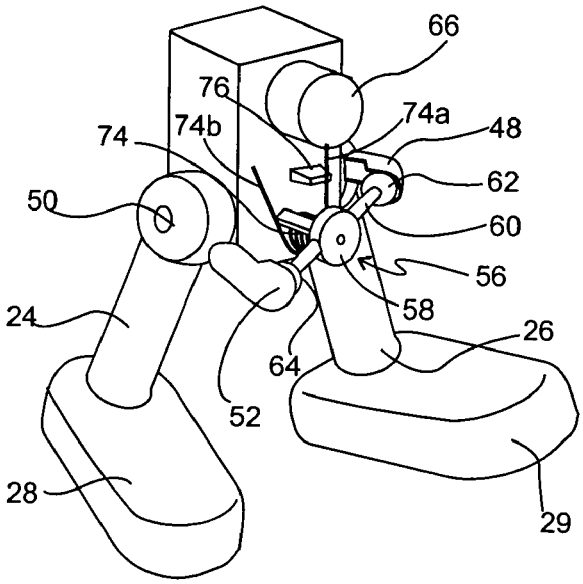
Fig 4b
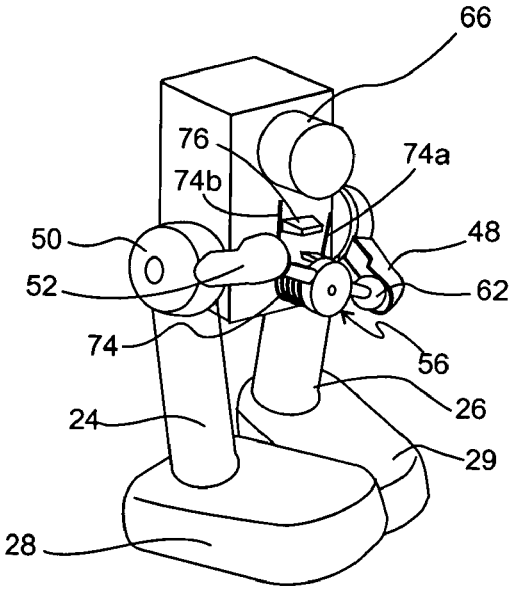
Fig 4c

WALKING TOY FIGURE

BACKGROUND OF THE INVENTION

Toy animals that walk and talk are among the most popular for young children. There is a constant need for toys of this type that are inexpensive, attractive and simple to operate. They serve as a continuous source of enjoyment and comfort.

SUMMARY OF THE INVENTION

There is herein described and illustrated a walking toy animal that is programmed and designed to walk and talk by simple switch mechanisms. The animal can be programmed to walk, run and turn as desired. The toy employs a simple teeter-totter mechanism to sequentially move the legs in the desired direction to perform the preprogrammed movements. Various switching devices are provided to operate when the toy has fallen down, his tummy is squeezed when he is on his feet, when its hand is pressed or it hears a loud sound.

To accomplish the various movements there is provided a motor operated assembly that provides for particular movements of the toy figure's legs. The legs are pivotally connected to the body portion of the figure and the whole torso of the toy is leaning forward at about 13 degrees off from the vertical when the feet are flat on the floor. To bring about the required movement a bi-directional motor driven gear assembly is activated to operate a teeter totter mechanism to first move one leg up and forward and at the same time the other leg is moved backward and then the motor is then reversed to move the one leg backward and the other leg forward. At the end of each stroke a spring is provided to assist in moving the legs back to their centering position.

The toy is constructed with its body leaning forward so that most of its weight is towards the front of the feet. Thus, when it moves one of its feet forward the body moves forward in a controlled fashion.

When the toy is to be walking or running straight a program controller that is provided moves one leg forward and the other leg backward the same length of time. In the case of turning a difference between the movement of one leg relative to the other other is provided to bring this about. This difference in the leg movement causes the toy to turn. For instance, if the toy is to turn to the right then the motor is programmed to operate in the following manner. The motion through the teeter-totter mechanism operates to bring the left leg back to its center position at which time the right leg also returns to the center position. The motor reverses at this time with the left leg again moving forward at which time the left leg creates friction with the floor, but the right leg moves backward freely resulting in a pivoting of the toy about the left leg causing the toy to turn right. This process is reversed for turning left.

The toy recognizes when it has fallen down using a ball switch in the back portion of the toy. It is designed to move when it hears a loud sound or its hand is pressed. A switch is located in the tummy portion of the toy and when pressed the toy also responds.

The details and operation of the toy animal will be clear from the following drawings and the description thereof in which:

FIGS. 4*a*, 4*b* and 4*c* illustrate a walking mode of the toy animal.

DETAILED DESCRIPTION OF THE DRAWINGS

Figure 1:
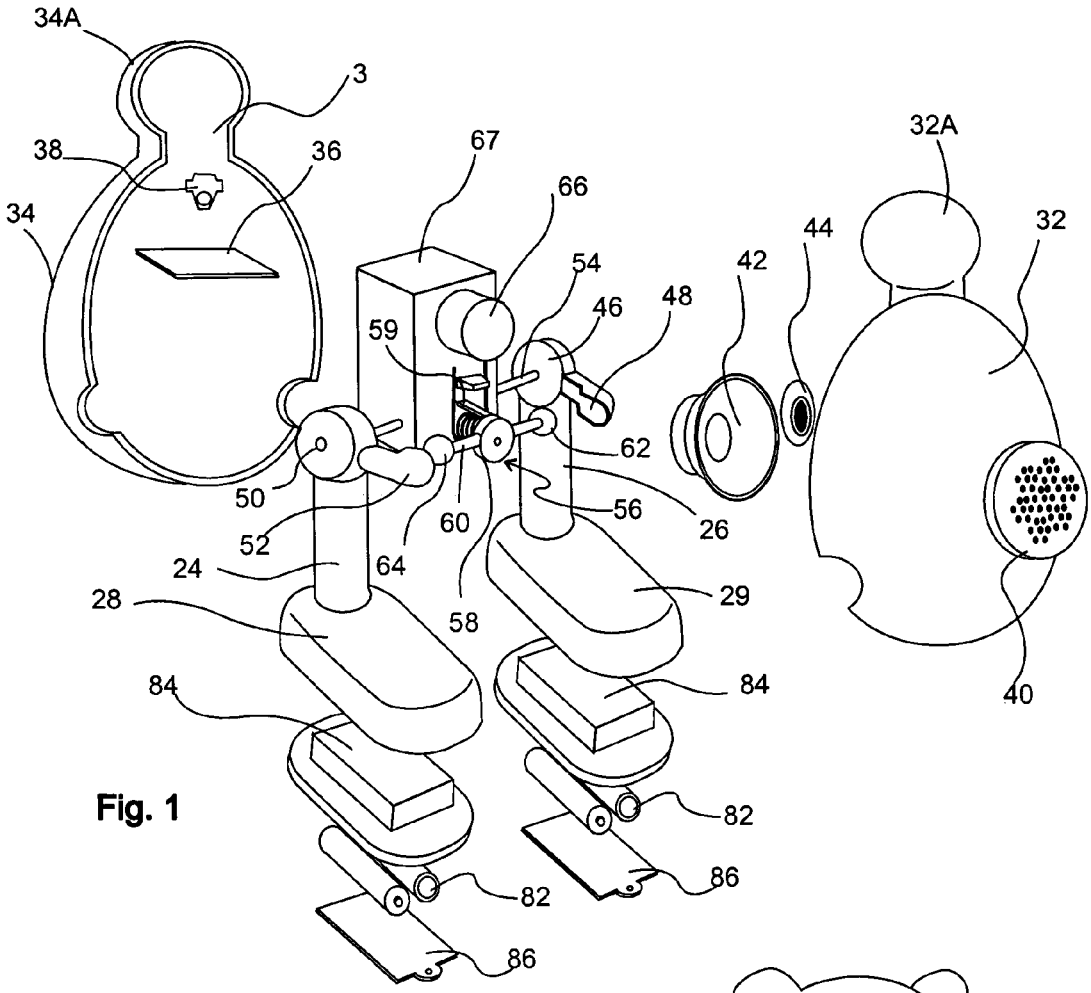
FIG. 1 is an exploded perspective view of the toy animal incorporating applicant's invention.
Figure 2:
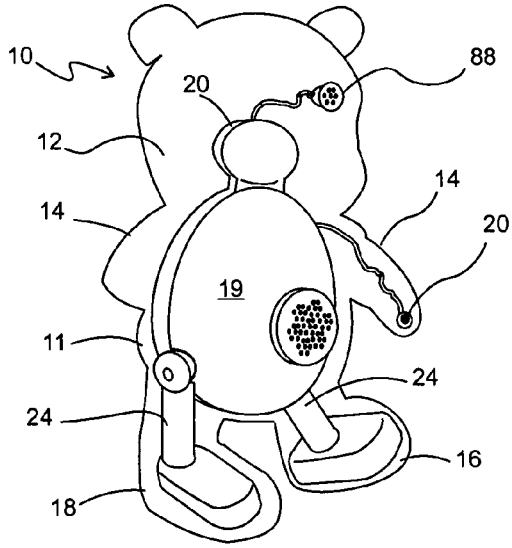
FIG. 2 is a view showing the various mechanisms located internally of applicants moved toy.

Referring first to FIG. 1 there is illustrated in an exploded view the mechanisms that brings about the various moving modes of the toy plush animal 10. In FIG. 2 the plush animal 10 is shown with the various mechanisms, legs and feet disposed within a plush skin 11. The plush skin 11 is in the form of a head 12, arms 14, left leg 16 and right leg 18. The plastic housing 19 in which the gear box, motor, electronic circuitry, speakers and various other components are located consists of an upper portion 20 and a body portion 22. Extending outwardly and downwardly from said body portion 22 are right leg 24 and left leg 26. The operating mechanism 30 for said legs 24, 26 will be discussed in detail hereinafter.

Connected to the right and left legs are right foot 28 and left foot 29 respectively. The feet are provided with a frictional surface that helps in its movement.

The plastic housing 19 is made up of a front cover 32 having an upper portion 32A and a rear cover 34 having an upper portion 34A. Located in the rear cover 34 are the electronics 36 that has a speech and program controller that determines how the toy reacts by way of sounds or movements when inputs, in the form of sounds or switches that are activated respond. These include the ball switch 38 that is activated when the toy falls down and other devices described hereinafter.

Located in the central portion of the front cover 32 is a mount 40 for a paper speaker 42. Also located in said front cover is a momentary switch 44 that will be activated when the tummy is pressed.

We now refer the details of the operating mechanism 30 which operate the legs to move in a manner programmed by the electronic controller 36.

To better understand the walking, turning or running mode of the toy reference is made to the construction of the legs and the movement thereof by a bi-directional motor. Referring first to the left leg 26 there is illustrated a generally cylindrical portion 46 that forms a hip joint to which is connected an outwardly extending ball receptacle 48. Similarly, the right leg 24 has located at its upper end a generally cylindrical member 50 that has connected thereto an outwardly extending ball receptacle 52. The cylindrical hip joints 46, 50 are rotatably connected to a pivoting shaft 54 whereby when the hip joints 46, 50, that are rigidly connected to their respective legs 26, 24, are moved relative to the shaft 54 the legs 26, 24 will be moved in the prescribed fashion.

Referring now to FIGS. 4*a*, 4*b* and 4*c* there is illustrated the operating leg mechanism 30 having moved the legs to various positions due to the operation of the teeter totter mechanism 56 by the motor 66.

Specifically in FIG. 4*a* there is shown the teeter-totter mechanism 56 in the assembled neutral position which includes an integral cylindrical portion 58 affixed to shaft 60 and balls 62, 64 connected to the outer ends of shaft 60. In the assembled position the balls 62, 64 are located in the ball receptacles 48, 52 respectively. Rotation of the shaft 60 in the counter clockwise direction and the attendant movement of the legs 24, 26 and their associated feet 28, 29 from the neutral position of FIG. 4*a* is shown in FIG. 4*b*. Movement of the shaft 60 in the clockwise direction and the attendant movement of the legs 24, 26 and their associated feet 28, 29 is shown in FIG. 4*c*. The movement caused by the shaft rotation will be discussed under the Method of Operation set forth hereinafter.

Figure 3:
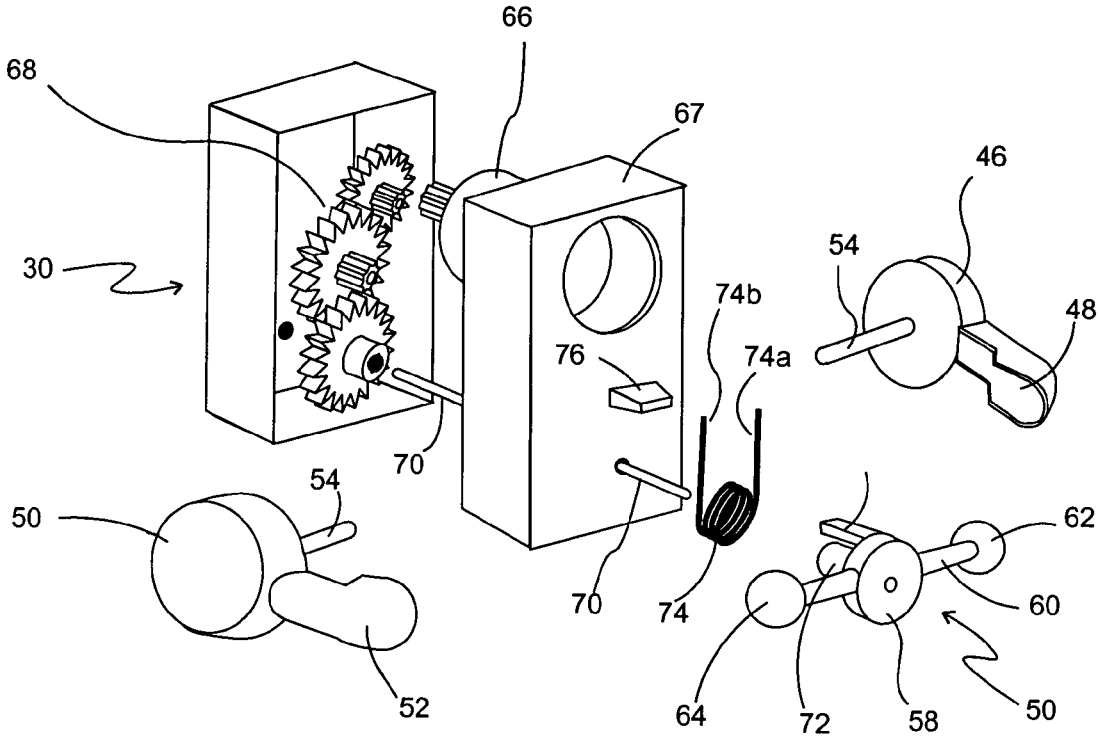
FIG. 3 is an exploded perspective view of the drive components of applicants toy animal.

We turn now to the details of the drive details for the teeter-totter mechanism 56 shown in the FIG. 3 exploded perspective view thereof.

The drive mechanism 30 includes a reversing motor 66 connected to a gear drive mechanism 68 located in a gear box 67. The gear drive 68 has an output shaft 70 that is connected to the central portion 58 of the teeter-totter mechanism 56. The central portion 58 of the teeter totter mechanism further includes an inwardly extending projection 59 that in the assembled position is positioned to limit the movement of the upper ends 74*a* and 74*b* of centering spring 74. When the rod 60 is moved clockwise projection 59 moves against spring leg 74*a* and when rod 60 is moved counter clockwise spring leg 74*a* assists in the movement of the rod 60 and leg 26 back to its center position. When the rod 60 is moved counter clockwise projection 59 engages spring leg 74*b* and when subsequently moved clockwise spring leg 74*b* assists in the movement of the rod 60 and leg 24 back to its center position. It remains to note that projection 76 on the gear box 67 restricts the movement of spring 74 to permit it to perform its intended function.

The motor 66 is bi-directional and is programmed to move the teeter-totter mechanism 56 first in one direction and then the other in the programmed sequence to move the legs in the prescribed manner.

The power for the toy animal is provided by the batteries 82 located in the battery case 84. A battery case cover 86 retains the batteries in position.

The toy animal includes a microphone 88 in the head portion of the toy animal 10 and a monitoring switch 90 in an arm 14 for actuating the various mechanisms of the toy 10.

METHOD OF OPERATION

The unique toy animal disclosed herein loves to walk, run and talk in a way that gives hours of pleasure to a child.

When in the standing position as set forth in FIG. 4*a* the centering spring 74 brings the teeter-totter mechanism to a center position with both feet flat on the floor. When it is activated to move by a loud sound or the pressing of the switch 90 in the arm 14, the program controller 36 is activated and motor 66 is operated to move the rod 60 counter clockwise as shown in 4*b* to lift the left leg. Essentially the ball receptacle 52 is pushed down on the right and the ball receptacle 48 is moved up on the left side. This causes the left leg to lift and at the same time the right leg pushes backwards. Similarly when the right leg has to lift, the motor reverses and teeter-totter mechanism moves as in FIG. 4*c* and the right leg is lifted while the left leg is pushed back. At the end of each stroke the spring 74 help the legs get back to their centering position.

When the toy is walking or running straight, the length of time which each leg is moved forward is the same. When the toy is programmed to turn the following actions take place. The motor is operated to move the legs to a centered position. The motor then is reversed to move the left leg forward with a dragging motion during which time the right leg moves backward freely. This backward movement of the right leg results in the toy animal pivoting about the left leg to turn the animal to the right. When it is desired to turn the animal to the left this action is reversed. That is the right leg is dragged forward and the left leg moves backward unimpeded to pivot the toy animal about its right foot and pivots the animal to the left.

It is intended to cover by the appended claim all embodiments that fall within the true spirit and cope of the invention.

The invention claimed is:

1. A movable toy assembly comprising a body portion, a pair of leg assemblies movably connected to said body portion and rotatably mounted on a transversely extending shaft, a bidirectional programmable motor driven assembly for said leg assemblies including a longitudinally extending drive shaft and a teeter-totter mechanism connected to said drive shaft, each leg assembly including an outwardly extending portion defined to receive an end of the teeter-totter mechanism, which outwardly extending portions includes a ball receiving receptacle and the teeter-totter mechanism includes a rod having at its ends balls to be received by said ball receiving receptacles, whereby when the drive shaft is operated in one direction one of the assemblies will be lifted up and moved forward while the other leg is moved backwards to bring about a moving action.

2. A walking toy assembly as set forth in claim 1 in which the middle of the rod includes an integral member that receives the motor drive shaft whereby when the drive shaft is moved in one direction the teeter-totter moves one way and when the drive shaft is reversed the teeter-totter moves in the opposition direction.

3. A walking toy assembly as set forth in claim 2 in which the integral member includes an extension member about which is located a centering spring means which acts to assist the teeter-totter mechanism in moving to a centering position when it is being moved by the drive shaft.

* * * * *